US006173748B1

(12) United States Patent
Paani

(10) Patent No.: US 6,173,748 B1
(45) Date of Patent: Jan. 16, 2001

(54) METHOD OF REDUCING NOISE IN A BARKING PLANT AND A BARKING DRUM, CHIPPER AND CONVEYING LINE

(75) Inventor: Jukka Paani, Pori (FI)

(73) Assignee: Valmet Woodhandling Oy, Pori (FI)

( * ) Notice: Under 35 U.S.C. 154(b), the term of this patent shall be extended for 0 days.

(21) Appl. No.: 09/391,396

(22) Filed: Sep. 8, 1999

(30) Foreign Application Priority Data

Sep. 9, 1998 (FI) ..... 981930

(51) Int. Cl.[7] ..... B27L 1/00; B27L 7/00

(52) U.S. Cl. ..... 144/340; 144/3.1; 144/162.1; 144/268.1; 144/208.3; 144/242.1; 144/367; 144/369; 144/364; 181/252

(58) Field of Search ..... 144/208.1, 208.3, 144/340, 242.1, 245.1, 3.1, 162.1, 176, 364, 367, 369; 181/248, 252, 247

(56) References Cited

U.S. PATENT DOCUMENTS 4,582,106 * 4/1986 Huhta et al. ..... 144/208.3

FOREIGN PATENT DOCUMENTS

667223 * 7/1963 (CA) ..... 144/208.3

* cited by examiner

*Primary Examiner*—W. Donald Bray

(74) *Attorney, Agent, or Firm*—Burns, Doane, Swecker & Mathis LLP

(57) ABSTRACT

A method of reducing noise in a barking plant; a barking drum, a chipper and a conveyor between these. The penetration of noise through conveying openings of a partly or wholly covered conveyor (3) for receiving logs from a barking drum (1), and/or a partly or wholly covered conveyor (8') for feeding logs to a chipper (11), is reduced, and the noise level is decreased by means of the water (21) used for washing the logs. The water forms a continuous curtain (18, 19) at the front and/or back end of the conveyor (3, 8, 8') between the drum (1) and the chipper (11).

16 Claims, 3 Drawing Sheets

Figure 1:
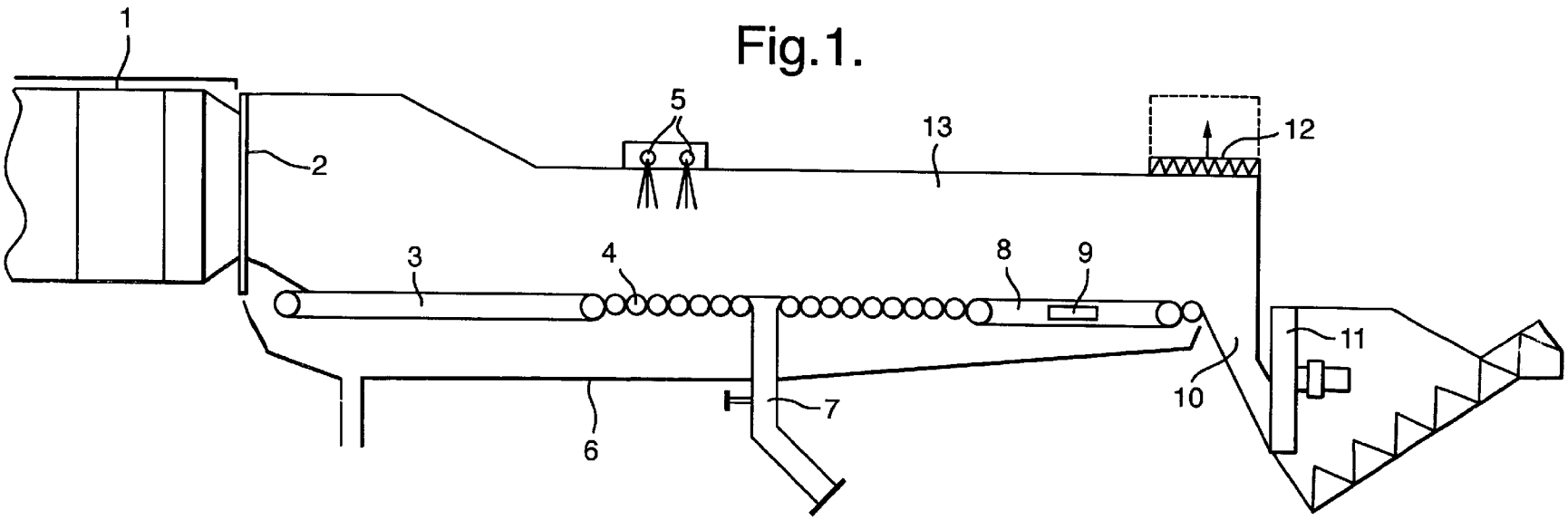

METHOD OF REDUCING NOISE IN A BARKING PLANT AND A BARKING DRUM, CHIPPER AND CONVEYING LINE

This invention relates to a method of reducing the noise caused by a barking drum and a chipper in a barking plant, on the log conveying line between the drum and the chipper.

In barking plants, big barking drums, chippers and other devices related to the process are used. They all cause a lot of noise. The background noise in a barking plant, when the drum and the chipper are not operating, is 80–85 dB (A). When the process is running, the noise may be 95–100 dB (A). In the proximity of the drum and of the chipper the noise may be 100–115 dB (A). In some new Scandinavian barking plants the objective is to lower the noise level so that it does not exceed 85 dB (A) in any part of the plant. Thus, more and more interest has been shown in developing means of reducing the noise caused by each machine of a barking plant, especially the noise caused by the drum and the chipper.

A barking drum causes noise as the logs to be barked hit against one another and against the shell of the drum. The low-frequency noise peaks occur at frequencies lower than 1000 Hz. The noise caused by a barking drum can be reduced by housing the drum in a concrete structure or in a structure composed of another soundproofing material. Furthermore, the drum can be placed in a separate room with respect to the other machines of the barking plant. In Scandinavia, the feeding of logs into a drum is performed by means of a thawing conveyor. The closed conveyor soundproofs the inlet of the drum effectively, but soundproofing the opening of the discharging end of the drum is more problematic. The conveyors between the drum and the chipper comprise a metal detector for detecting pieces of metal carried with the logs. The metal detector may stop the process even 10 times an hour. The removal of logs containing metal and of other pieces of metal from the stopped conveyors is performed manually, which is why the conveyors have to be easily accessible.

When removing the metal-containing logs, the workers are often subjected to a noise level of about 90–100 dB (A).

Not only drums can be isolated from their surroundings; the same can be done to a chipper.

In this case, isolating the feed opening of the chipper is as difficult as isolating the discharge end of a drum. The feed opening cannot be closed to a sufficient degree, in order not to prevent the inconsistent log flow from freely entering the feeding chute.

The characteristics of this invention are set forth in claim 1. The characteristics of the barking drum, chipper and conveying line according to the invention are set forth in claims 4, 5 and 6. The invention makes it possible to reduce the noise coming from the discharge opening of a drum and from the feeding chute of a chipper in such a way that it does not become substantially more difficult to work at the conveyors between the drum and the chipper. According to the invention, the openings through which the logs flow are closed by means of a water curtain.

Figure 2:
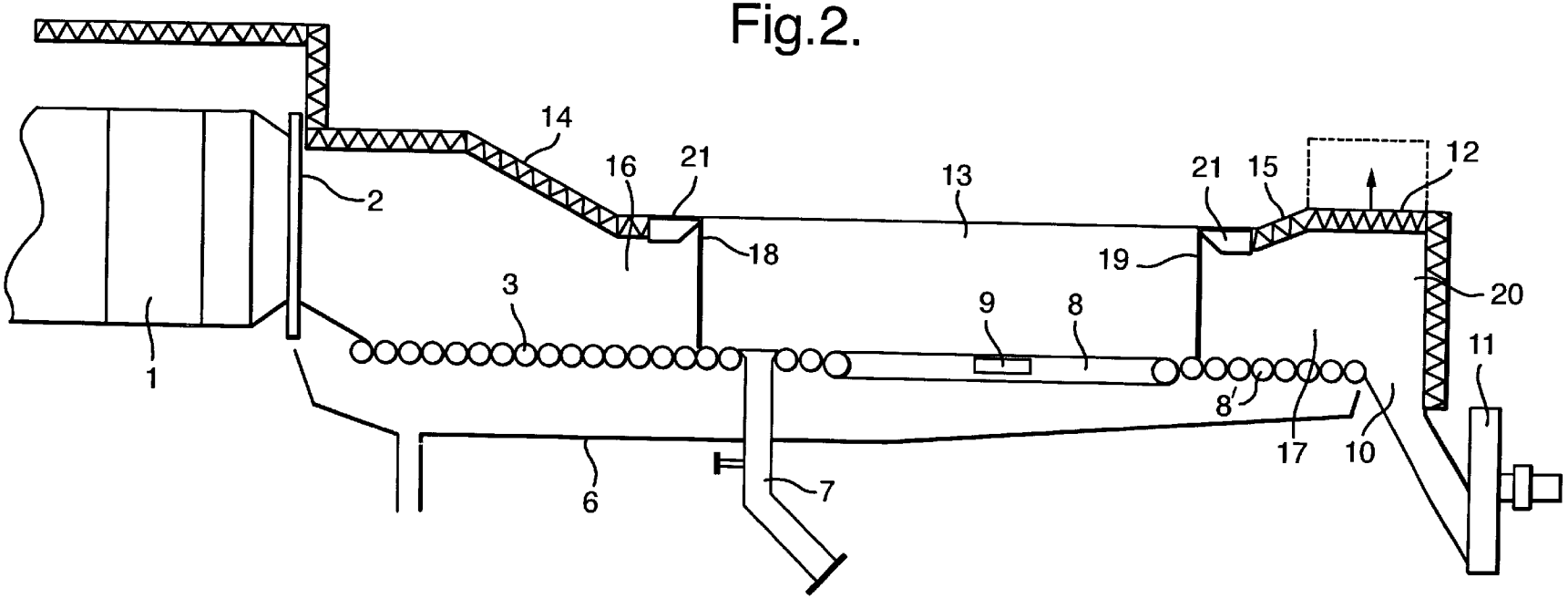
Figure 3:
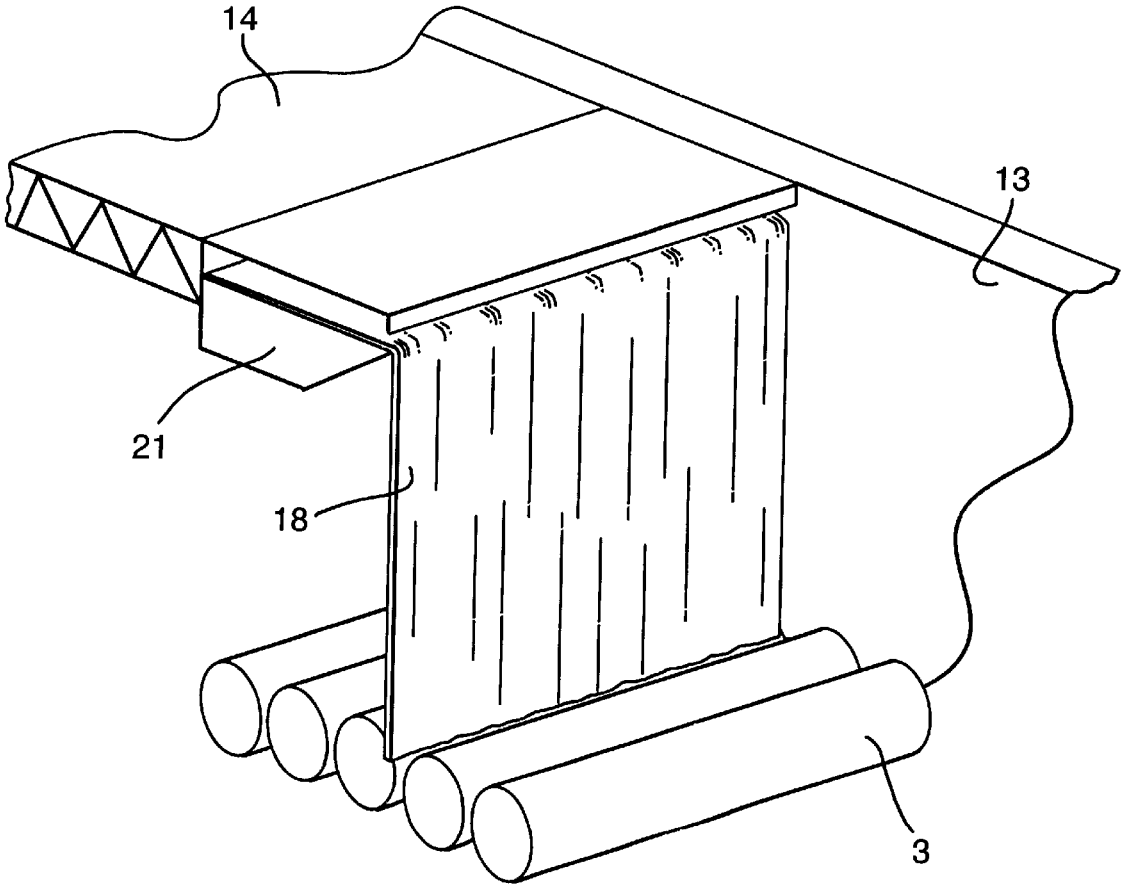

The invention and the details thereof will now be described in more detail with reference to the accompanying drawings wherein FIG. 1 shows a typical section between a barking drum and a chipper in a barking plant, FIG. 2 shows the noise-reducing method according to the invention applied to conveyors working between a barking drum and a chipper, and FIG. 3 shows a method of forming a water curtain.

The logs fall through the outlet 2 of the discharge end of a barking drum 1 onto a receiving conveyor 3 (FIG. 1). After the receiving conveyor washing rollers 4 are placed. The logs are washed on the rollers 4 by means of water jets 5. The water jets 5 are usually arranged in one, two or three lines. In the first line, or in the first lines, the washing is performed by means of the circulating water of the barking plant, whereas the water of the last line is often mechanically purified fresh water. The water and the scrap that has come off the logs fall, through the gaps between the rollers, into a water chute 6. The washing rollers 4 are usually provided with one or two stone traps 7 filled with water for removing the biggest stones carried with the logs. The stone traps often cause trouble, and therefore should be easily accessible.

The conveyor 8 located after the rollers comprises a metal detector 9. After the last conveyor 8 a chipper 11 for chipping the wood and a feeding chute 10 for the chipper are provided. The feeding chute 10 has a cover 12 above it for reducing the noise. The cover can be opened and, consequently, logs that have stuck in the feeding chute 10 can be removed using, for example, a bridge crane. The conveyor is provided with side walls 13 but has an open top. When the process does not run properly due to occurrence of metal or other process disturbances, logs are lifted from the conveyors by means of bridge cranes or other cranes.

In many plants, the receiving conveyor 3 for the logs coming from the drum, as well as the feed conveyor 8 of the chipper, are nowadays provided with a noise-reducing top 14 and 15 (FIG. 2). Hence, the noise reaches the line between the drum and the chipper only through the log conveying openings 16 and 17.

In the noise-reducing method according to the invention, a noise-reducing and noise-absorbing material covers both the drum and the beginning of the conveying line between the drum and the chipper, in the manner known from the prior art. The noise level is typically 110 dB (A) at the drum outlet 2. The washing of the logs is arranged at the end 16 of the noise-reducing cover 14. The washing water, which is constituted by the circulating water of the barking plant, forms a continuous water curtain 18 and therefore simultaneously reduces the noise coming from the drum. The water curtain can be formed by means of nozzles or from water freely overflowing from a water basin 21, as shown in FIG. 3.

The stone trap 7 is placed outside the cover 14 so that any malfunction that may occur therein it is easy to rectify. The metal detector 9 is also placed in an open-top space.

The end of the conveying line between the drum and the chipper is also covered with a noise-reducing and noise-absorbing material 15. The front edge of the cover is provided with a water curtain 19 of the same type as the one at the beginning of the conveyor line.

Instead of the circulating water, fresh water can be used at this site. The noise level above 20 the feeding chute of the chipper can be 115 dB (A). By covering the end of the conveying line with the noise-absorbing material 15, the noise level can be lowered so that it is approximately 100 dB (A) at the water curtain 19 of the chipper inlet. The noise can be further reduced, by 10–15 dB (A), by means of the water curtain, depending on the thickness of the water curtain.

The water-based reduction of noise after the drum and before the chipper can be performed using one or more water curtains.

What is claimed is:

1. A method of reducing noise in a barking plant comprising the steps of:

forming a continuous curtain of washing water for logs at at least one of a beginning and an end of a conveying line between a barking drum and a chipper.

2. A method as defined in claim 1, wherein the water curtain includes circulating water used in the barking plant.

3. A method as defined in claim 1, wherein noise reduction is performed by forming more than one successive water curtains.

4. A method as defined in claim 1, wherein the water curtain is formed by spraying water with nozzles.

5. A method as defined in claim 2, wherein noise reduction is performed by forming more than one successive water curtains.

6. A method as defined by claim 2, wherein the water curtain is formed by spraying water with nozzles.

7. A method as defined by claim 3, wherein the water curtain is formed by spraying water with nozzles.

8. A method as defined by claim 5, wherein the water curtain is formed by spraying water with nozzles.

9. A method as defined in claim 1, wherein the water curtain is formed by causing an overflow of water over an edge of a water basin.

10. A method as defined in claim 2, wherein the water curtain is formed by causing an overflow of water over an edge of a water basin.

11. A method as defined in claim 3, wherein the water curtain is formed by causing an overflow of water over an edge of a water basin.

12. A method as defined in claim 5, wherein the water curtain is formed by causing an overflow of water over an edge of a water basin.

13. A barking drum having an at least partly covered receiving conveyor for logs coming from the drum and a source of water for the logs coming from the drum provided above the receiving conveyor, the source of water providing water in a form of a continuous curtain that covers a conveying opening of the receiving conveyor.

14. A chipper having an at least partly covered feed conveyor and a source of water disposed on an underside of a top of the feed conveyor, the water coming from the source of water forming a continuous curtain that covers a conveying opening of the feed conveyor.

15. A conveyor arrangement located between a barking drum and a chipper in a barking plant, comprising:

a conveying line:

an enclosure for the conveying line including side walls and a top at least partly covering the conveying line; and a source of water for logs that are conveyed on the conveying line, the source of water being disposed at at least one of a beginning and an end of the conveying line proximate an underside of the top so that water coming from the source of water forms a continuous curtain that covers an opening of the conveying arrangement.

16. A conveying arrangement as defined in claim 15, further comprising at least one of a stone trap and a metal detector located in the top.

* * * * *